US006514321B1

(12) United States Patent
Lehto et al.

(10) Patent No.: US 6,514,321 B1
(45) Date of Patent: Feb. 4, 2003

(54) DEHUMIDIFICATION USING DESICCANTS AND MULTIPLE EFFECT EVAPORATORS

(75) Inventors: John M. Lehto, Cokato, MN (US); John Tyson, Houston, TX (US)

(73) Assignee: PowerMax, Inc., Houston, TX (US)

( * ) Notice: Subject to any disclaimer, the term of this patent is extended or adjusted under 35 U.S.C. 154(b) by 0 days.

(21) Appl. No.: 09/691,348

(22) Filed: Oct. 18, 2000

(51) Int. Cl.[7] ..... B01D 53/14

(52) U.S. Cl. ..... 95/180; 95/188; 95/193; 95/231; 96/234; 96/242

(58) Field of Search ..... 95/156, 178, 179, 95/180, 186, 193, 194, 188, 189, 227, 228, 231; 96/234, 236, 242

(56) References Cited

U.S. PATENT DOCUMENTS

| | | | | |
|---|---|---|---|---|
| 1,791,086 | A | * | 2/1931 | Sperr, Jr. |
| 2,182,453 | A | | 12/1939 | Sellew |
| 2,690,656 | A | | 10/1954 | Cummings |
| 4,287,721 | A | | 9/1981 | Robison |
| 4,373,347 | A | | 2/1983 | Howell et al. |
| 4,860,548 | A | * | 8/1989 | Ryham |
| 4,963,231 | A | | 10/1990 | Ryham |
| 4,979,965 | A | * | 12/1990 | Sannholm |
| 5,024,062 | A | | 6/1991 | Hellman |
| 5,203,161 | A | | 4/1993 | Lehto |
| 5,766,423 | A | | 6/1998 | Smith |
| 5,922,109 | A | | 7/1999 | Rooney et al. |

FOREIGN PATENT DOCUMENTS

| | | |
|---|---|---|
| WO | WO 93/09198 | 5/1993 |
| WO | WO 99/32841 | 7/1999 |

* cited by examiner

*Primary Examiner*—Duane S. Smith
(74) *Attorney, Agent, or Firm*—Merchant & Gould P.C.

(57) ABSTRACT

A system and method for dehumidifying air including a multiple effect evaporator that creates a concentrated desiccant solution. The desiccant solution from the multiple effect evaporator is conveyed to a desiccant spray chamber that sprays the cooled desiccant solution into an air stream. The desiccant solution absorbs water vapor from the air stream creating a desiccant and water solution. A conduit transfers the water and desiccant solution to the multiple effect evaporator for removal of the water from the desiccant solution.

22 Claims, 3 Drawing Sheets

DEHUMIDIFICATION USING DESICCANTS AND MULTIPLE EFFECT EVAPORATORS

BACKGROUND OF THE INVENTION

The present invention relates to methods and systems for dehumidifying air for use in dryers and air conditioners.

For a variety of reasons, it is desirable to reduce the moisture content of the air. For example, in certain industrial operations (e.g., the manufacture of integrated circuits), it is desirable to maintain the air within the manufacturing facility at a low relative humidity. Additionally, in warehouses which store material subject to corrosion, it has been found that a lower relative humidity within the warehouse inhibits the corrosion of the materials. Other applications that require air with a lower relative humidity include drying products (e.g., farm products such as grain) and the air supplied to the inlet of gas turbine engines. Furthermore, the energy costs related to air conditioning can be minimized through the use of a dehumidifier.

Methods for removing water vapor in gases may generally be classified into four methods: compression method, an adsorption/absorption method, a cooling method, and a membrane separation method. Efficiency, space limitations, and the application to which the dehumidified air will be applied are all considerations that might be addressed when choosing a method for dehumidifying air.

The absorption method of dehumidification may include the use of a desiccant solution that absorbs water vapor in the air. A number of liquids are commonly used as desiccants such as lithium bromide, lithium chloride, ethylene glycols, and potassium formate. When practicing an absorption method of dehumidification, a desiccant is sprayed into an air stream at a spray chamber. As the air stream flows through the spray of desiccant, water vapor in the air stream is absorbed into the desiccant causing the air to be dehumidified. As the desiccant absorbs water, it becomes diluted. To maintain the dehumidifying capacity of the system, the absorbed water must be removed from the desiccant. This is typically accomplished at a boiler where water is evaporated from the desiccant. After water has been evaporated from the desiccant, the concentrated desiccant from the boiler is cycled back to the spray chamber where the desiccant again absorbs water from the air stream.

SUMMARY OF THE INVENTION

One aspect of the present invention relates to a system for dehumidifying air. The dehumidifying system includes a multiple effect evaporator that efficiently creates a concentrated desiccant solution. The desiccant solution from the multiple effect evaporator is transferred to a desiccant spray chamber that sprays the desiccant solution into an air stream. The desiccant solution absorbs water vapor from the air stream. A conduit transfers at least some of the desiccant containing the absorbed water back to the multiple effect evaporator for removal of the water from the desiccant solution. Thereafter, the concentrated desiccant is cycled back to the spray chamber, and the process is repeated. In embodiments where it is desirable to cool the air stream, a cooling structure can be used to cool the desiccant before the desiccant is sprayed into the spray chamber. To further cool the air stream, an air cooler can be positioned downstream from the spray chamber.

The present invention also relates to a method for dehumidifying air. The method includes providing a water and desiccant solution to a multiple effect evaporator for producing a concentrated desiccant solution. The concentrated desiccant solution is transferred to a spray chamber where the desiccant solution is sprayed into an airflow stream. The sprayed desiccant absorbs water vapor from the air creating a water and desiccant solution that is transferred to the multiple effect evaporator for removal of water from the desiccant solution. If air conditioning is desired, dehumidified air exiting the desiccant spray chamber can be cooled by a method of cooling air. In such embodiments, a cooling structure can also be used to cool the desiccant before the desiccant is sprayed into the spray chamber.

DETAILED DESCRIPTION OF THE DRAWINGS

DETAILED DESCRIPTION OF THE PREFERRED EMBODIMENT

The present invention is applicable to dehumidifiers and making and using dehumidifiers to remove water vapor from a gas, such as, for example, air. In particular, the present invention is directed to dehumidifiers using a desiccant to absorb water vapor from air and a multiple effect evaporator for removing the absorbed water from the desiccant. The present invention also relates to air conditioners that include a dehumidifier and the further capability of cooling dehumidified air generated by the dehumidifier. While the present invention may not be so limited, an appreciation of various aspects of the invention will be gained through a discussion of the examples provided below.

Figure 1:
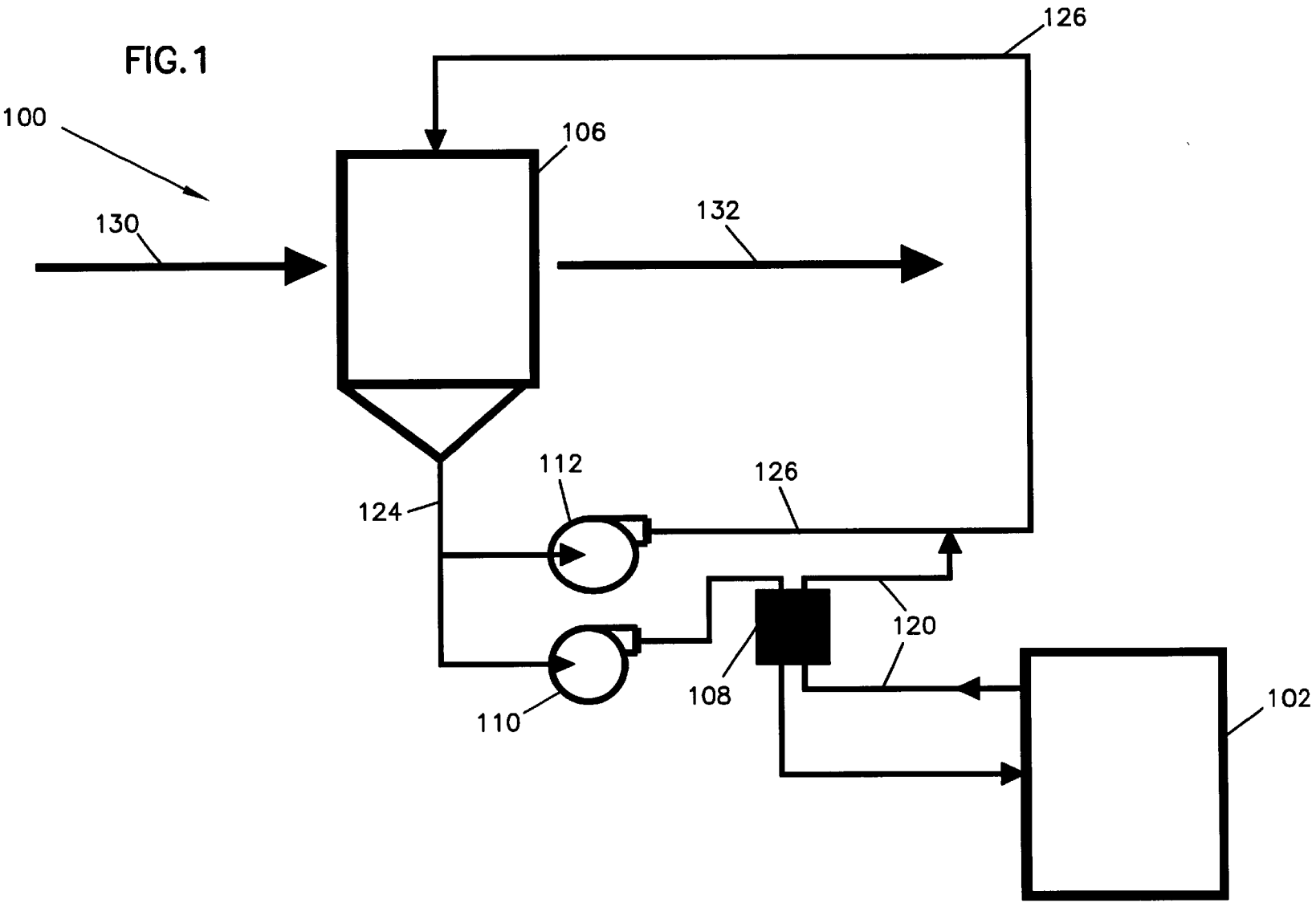
FIG. 1 is a schematic representation of one embodiment of a dehumidifier, according to the invention.
Figure 2:
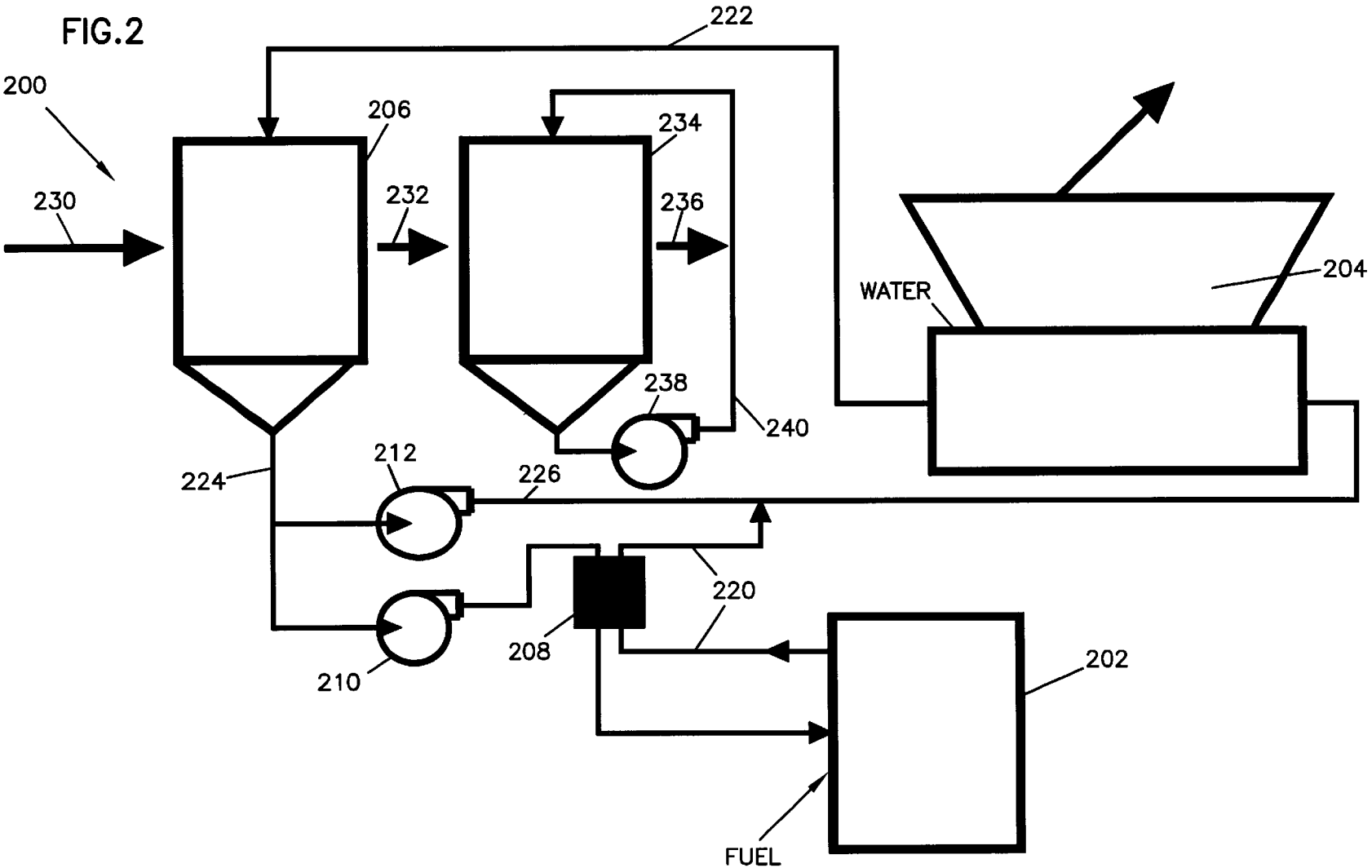
FIG. 2 is a schematic representation of one embodiment of an air conditioner, according to the invention.

FIGS. 1–2 are schematic drawings of dehumidifying and air conditioning systems constructed in accordance with the principles of the present invention. The figures illustrate several embodiments and the relative placement of components and other items of the systems, but are not intended to limit the scope of the present invention as defined by the claims.

FIG. 1 shows one example of a dehumidifier 100 of the present invention. The dehumidifier 100 includes a multiple effect evaporator 102, a spray chamber 106, a heat exchanger 108, and pumps 110 and 112. In general use, multiple effect evaporator 102 is adapted to provide a concentrated desiccant solution (e.g., a potassium formate solution). The concentrated desiccant solution from multiple effect evaporator 102 is conveyed to spray chamber 106 where the desiccant is sprayed into a humid air stream 130. Within the spray chamber 106, the desiccant absorbs water from the air stream 130 thereby dehumidifying the air stream. Thereafter, at least a portion of the desiccant containing the absorbed water is conveyed back to multiple effect evaporator 102 for removal of the absorbed water.

For applications in which warm dry air is desired, the dehumidifier system of FIG. 1 operates as follows. Air stream 130 is drawn into spray chamber 106 in which air stream 130 is in direct contact with the desiccant solution being sprayed in spray chamber 106. Water vapor in the air is absorbed into the liquid desiccant droplets and leaves spray chamber 106 in a water and desiccant solution that exits the spray chamber in conduit 124. Water from air stream 130 is added continuously to the liquid desiccant solution being sprayed in spray chamber 106. Thus, water preferably is removed from the system at the same rate the system absorbs water at the spray chamber. Otherwise, the desiccant will eventually lose its ability to absorb more water and the process would cease. This water removal function is preferably provided by multiple effect evaporator 102.

A portion of the water and desiccant solution exiting spray chamber 106 is pumped by pump 110 through conduit 124 into heat exchanger 108 in which the desiccant solution exiting spray chamber 106 is heated. The warmed desiccant solution exiting heat exchanger 108 is conveyed to multiple effect evaporator 102. In multiple effect evaporator 102, the water and desiccant solution is heated which causes the water to evaporate and a more concentrated liquid desiccant solution is created. The hot, concentrated desiccant solution exits multiple effect evaporator 102 in conduit 120 and passes through heat exchanger 108 in which the hot desiccant solution transfers heat to the cool water and desiccant solution contained in conduit 124. Warm concentrated desiccant solution exiting heat exchanger 108 in conduit 120 then combines with that portion of the cool water and desiccant solution being drawn from conduit 124 by pump 112 into conduit 126.

For this application, in which warm dry air is the desired output, the combined solution of conduits 120 and 126 is transferred to spray chamber 106. In this arrangement, the desiccant solution heats the air stream 130 passing through the spray chamber resulting in a heated and dehumidified air stream 132. For example, air entering spray chamber 106 at a temperature of 50 F. and 60% relative humidity might exit spray chamber 106 at 65 F. and 20% relative humidity.

In the process described above, the latent heat of the water vapor in the ambient air is removed through the use of less energy than conventional processes. When the warm dry air is used to dry, for example, grain, it will cause water in the grain to evaporate. A significant factor of energy efficiency in this process of evaporating water from the grain is supplied by multiple effect evaporator 102.

In applications where a lower output air temperature is desired, the combined desiccant solution flows of conduits 120 and 126 are preferably continuously cooled in a cooling structure before entering spray chamber 106. The cooling structure is preferably a wet cooling tower (e.g., an evaporative cooler) in which the solution can be cooled to a few degrees above the wet bulb temperature of the air stream 130 passing through spray chamber 106. A desiccant solution at such a temperature removes water vapor from air stream 130 and disposes of the latent heat of evaporization in cooling tower 104. This requires much less energy than removing the water vapor through a refrigeration process that condenses the water vapor, for instance, on coil fins.

A typical evaporative cooler for use in pre-cooling the desiccant includes a cascade of cooling fluid (e.g., water) that flows over pipes conveying the desiccant. As the cooling fluid flows over the pipes, heat from the desiccant causes the cooling fluid to evaporate. In this manner, heat is drawn from the desiccant thereby causing the desiccant to be cooled.

FIG. 2 shows an air conditioner 200 constructed in accordance with the principles of the present invention. The air conditioner 200 includes a multiple effect evaporator 202, a cooling structure 204 (e.g., an evaporative cooling tower), a spray chamber 206, a heat exchanger 208, pumps 210 and 212, an air cooler 234, and conduits 220–226 which transfer fluid throughout the system. Air cooler 234 further contains pump 238 for transferring fluid through conduit 240.

The system, as illustrated in FIG. 2, functions to remove water vapor from an air stream 230 and to further cool air stream 230. The process begins with the step of concentrating a desiccant solution in multiple effect evaporator 202. Multiple effect evaporator 202 concentrates the desiccant solution by heating the solution which, in turn, evaporates water from the solution. The hot desiccant solution exits multiple effect evaporator 202 through a conduit 220 into heat exchanger 208. At heat exchanger 208, heat contained in the concentrated desiccant solution is used to pre-heat desiccant being fed into the multiple effect evaporator from spray chamber 206. From heat exchanger 208, the warm concentrated desiccant solution in conduit 220 mixes with desiccant solution being carried by line 226 from spray chamber 206 to cooling structure 204. At cooling structure 204, the desiccant carried by conduit 226 is cooled. Cooling structure 204 is preferably a wet cooling tower in which the solution can be cooled to a few degrees above the wet bulb temperature of air stream 230 entering dehumidifier 200.

The cooled concentrated desiccant solution travels through conduit 222 to spray chamber 206. Air stream 230 is drawn into spray chamber 206 where air stream 230 is in direct contact with cooled concentrated desiccant solution being sprayed into air stream 230. Water vapor in air stream 230 is absorbed into the liquid desiccant droplets and exits the spray chamber in a water and desiccant solution. The water and desiccant solution exits spray chamber 206 through conduit 224. A portion of the water and desiccant solution in conduit 224 is pumped by pump 212 into conduit 226 for mixing with the concentrated desiccant solution in conduit 220 that has exited heat exchanger 208. The remaining desiccant stream exiting spray chamber 206 is pumped by pump 210 into heat exchanger 208. Heat exchanger 208 transfers heat from the hot concentrated desiccant solution exiting multiple effect evaporator 202 into the water and desiccant solution carried by conduit 224. The water and desiccant solution exiting heat exchanger 208 in conduit 224 then enters multiple effective evaporator 202 which concentrates the desiccant solution.

A dehumidified air stream 232 exiting spray chamber 206 may be cooled using conventional refrigeration techniques (e.g., vapor compression techniques or absorption techniques). As shown in FIG. 2, the air stream 232 is cooled through the use of a water spray air cooler 234. When cooling a dehumidified air stream with a water spray air cooler, the dehumidified air stream 232 enters air cooler 234 where the air stream it is contacted with water droplets. The water evaporates into air stream 232 causing the temperature of the air to fall. The amount of water added to the air is controlled in order to establish a specific relative humidity of the cooled air 236 exiting the air cooling chamber 234.

The process illustrated in FIG. 2 and described above functions to remove both the water vapor and its latent heat of evaporization from an air stream 230 without the use of any refrigeration. The latent heat involved in this process is absorbed by the liquid desiccant. Thus, the process shown in FIG. 2 is more energy efficient than an air conditioning system utilizing refrigeration or other traditional means of cooling air. The primary source of energy efficiency is multiple effect evaporator 202.

Figure 3:
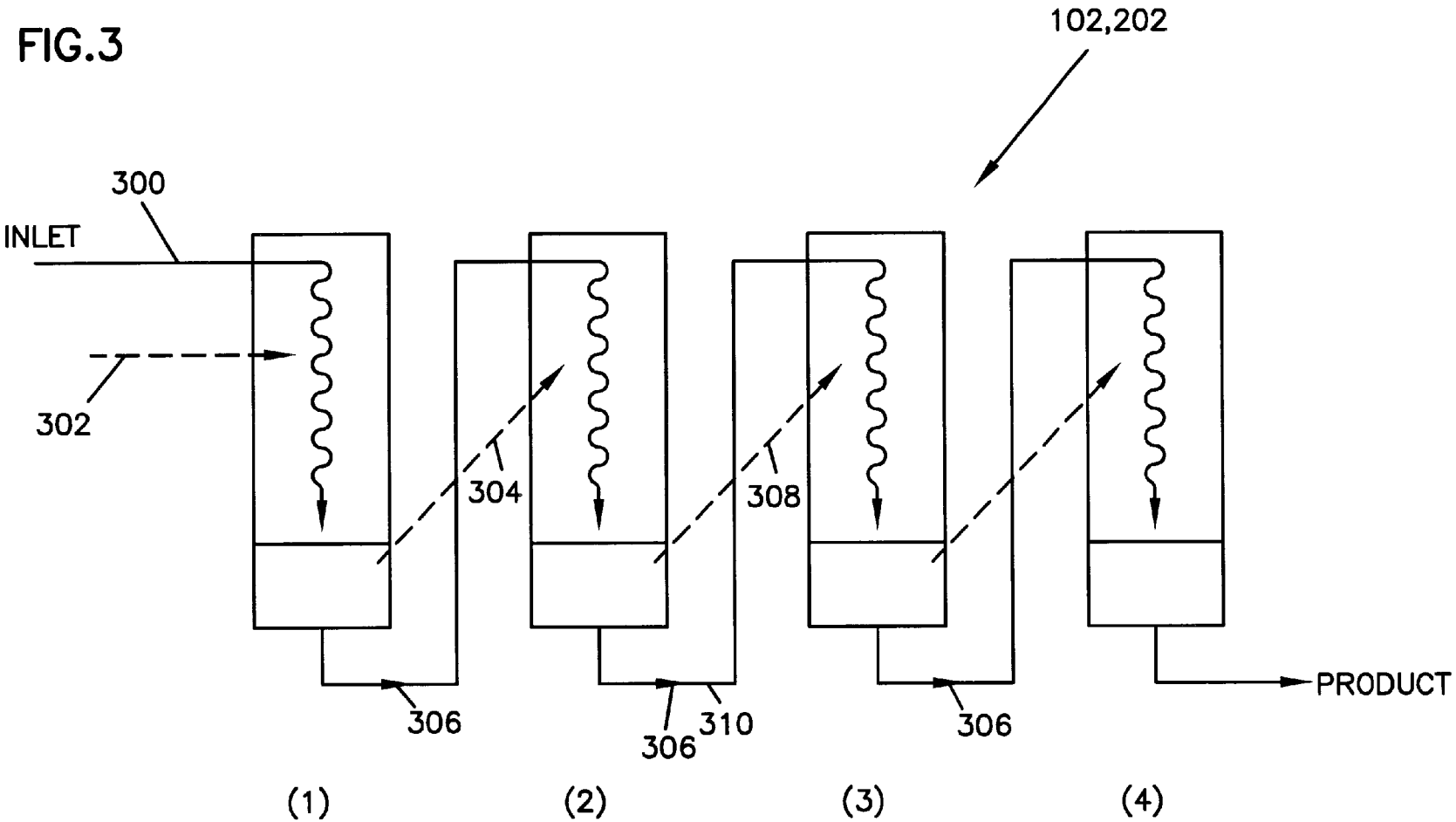
FIG. 3 is a schematic representation of one multiple effect evaporator suitable for application in the dehumidifier and air conditioner schematic representations of FIGS. 1 and 2.

Multiple effect evaporators are designed to be highly efficient through the use of multiple stages or effects. Such a multiple effect evaporator, is shown in FIG. 3. Solution under high pressure enters the first stage (1) through inlet 300. The incoming solution is heated by an exterior source such as steam 302 or another suitable heat source. Steam generated in the first stage (1) of the multiple effect evaporator is directed through line 304 into the second stage (2). Hot liquid from the first stage (1) passes through a pressure-reducing valve or orifice 306 into the second stage (2). The liquid boils at a lower temperature than in the first stage (1) because the liquid is at a lower pressure. The steam from stage 1 condenses while transferring its heat into the liquid of the second stage (2).

Steam generated in the second stage (2) passes through line 308 into the third stage (3) to further heat the hot liquid entering the third stage (3) in line 310. Line 310 includes pressure reducing valve 306. This process continues through as many stages as desired. Each additional stage uses the latent heat again and increases thermal efficiency of the process. Each additional stage also increases the cost of the equipment, so an optimal number of stages is chosen for each application.

The heat source for such a multiple effect evaporator may be a conventional fuel such as natural gas or propane, or it may be steam, a waste material, or methane generated on-site from natural products such as manure.

Air cooler 234 is preferably a water spray evaporative cooler in which water is sprayed over an incoming air stream. For some applications, evaporative cooling of dehumidified air stream 232 is not desirable. The dehumidified air stream 232 may be cooled using conventional vapor, compression refrigeration or absorption refrigeration equipment. Because the liquid desiccant has removed the latent heat of the water vapor, the total refrigeration process is more efficient than if conventional air cooling processes alone are used. Since this refrigeration is only required to remove sensible heat, rather than both sensible and latent heat, less total energy is required to be removed for the same total refrigeration effect. Thus, the dehumidifying process shown in FIG. 1 and the air conditioning process illustrated in FIG. 2 produce the respective drying or cooling effects at a much more efficient rate than conventional practices.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A dehumidifier for dehumidifying an air stream, comprising:

(a) a multiple effect evaporator for creating a concentrate desiccant solution comprising potassium formate;

(b) a desiccant spray chamber, for spraying desiccant received from the multiple effect evaporator into the air stream such that the desiccant solution absorbs water vapor from the air stream creating a water and desiccant solution; and (c) a conduit for conveying the water and desiccant solution to the multiple effect evaporator where the absorbed water is removed from the desiccant solution.

2. The dehumidifier of claim 1, further comprising a cooling structure for pre-cooling the desiccant solution from the multiple effect evaporator before the desiccant solution is sprayed into the spray chamber.

3. The dehumidifier of claim 2, wherein the cooling structure includes an evaporative cooler.

4. The dehumidifier of claim 1, wherein the water and desiccant solution leaving the desiccant spray chamber is heated in a heat exchanger by the concentrated desiccant solution leaving the multiple effect evaporator.

5. The dehumidifier of claim 1, wherein a portion of the water and desiccant solution leaving the desiccant spray chamber is combined with concentrated desiccant solution leaving the multiple effect evaporator.

6. The dehumidifier of claim 1, wherein a dehumidified air stream exits the spray chamber, and wherein the dehumidified air stream that exits the desiccant spray chamber enters an air-cooling chamber for cooling the air stream.

7. The dehumidifier of claim 6, wherein the air-cooling chamber includes a vapor compression refrigeration system.

8. The dehumidifier of claim 6, wherein the air-cooling chamber includes an evaporative cooler.

9. The dehumidifier of claim 6, wherein the air-cooling chamber includes an absorption refrigeration system.

10. A method of dehumidifying an air stream, comprising:

(a) providing a water and potassium formate solution to a multiple effect evaporator;

(b) removing water from the water and potassium formate solution using the multiple effect evaporator to provide a concentrate potassium formate solution;

(c) providing an airflow stream into a desiccant spray chamber;

(d) conveying the potassium formate solution from the multiple effect evaporator to the desiccant spray chamber, and spraying the potassium formate solution into the airflow stream such that water vapor from the airflow stream is absorbed into the potassium formate solution; and (e) returning the water and potassium formate solution from the spray chamber to the multiple effect evaporator.

11. A method according to claim 10, further comprising pre-cooling the potassium formate solution from the multiple effect evaporator before the potassium formate solution is conveyed to the spray chamber.

12. A method according to claim 10, wherein the potassium formate solution is pre-cooled in an evaporative cooler.

13. A method according to claim 10, wherein the potassium formate solution is pre-cooled to a temperature a few degrees above the wet bulb temperature of the air stream.

14. A method according to claim 10, wherein the step of returning the water and potassium formate solution from the spray chamber to the multiple effect evaporator includes heating the water and potassium formate solution in a heat exchanger using concentrated potassium formate solution exiting the multiple effect evaporator.

15. A method of dehumidifying an air stream, comprising the steps of:

(a) providing a water and potassium formate solution to a multiple effect evaporator;

(b) removing water from the water and potassium formate solution using the multiple effect evaporator to provide a concentrate potassium formate solution;

(c) conveying the concentrated potassium formate solution to a cooling structure, and cooling the concentrated potassium formate solution in the cooling structure to provide a cooled potassium formate solution;

(d) providing an airflow stream into a desiccant spray chamber;

(e) conveying the cooled potassium formate solution to the desiccant spray chamber, and spraying cooled potassium formate solution into the airflow stream such that water vapor from the airflow stream is absorbed into the cooled potassium formate solution to create a dehumidified airflow stream;

(f) returning the water and potassium formate solution from the spray chamber to the multiple effect evaporator; and (g) cooling the dehumidified airflow stream that exits the desiccant spray chamber.

16. A dehumidifier for dehumidifying an air stream, comprising:

a multiple effect evaporator for creating a concentrate desiccant solution;

a desiccant spray chamber, for spraying desiccant received from the multiple effect evaporator into the air stream such that the desiccant solution absorbs water vapor from the air stream creating a water and desiccant solution;

a conduit for conveying the water and desiccant solution to the multiple effect evaporator where the absorbed water is removed from the desiccant solution; and a cooling structure having a evaporative cooler for precooling the desiccant solution from the multiple effect evaporator before the desiccant solution is sprayed into the spray chamber.

17. A dehumidifier for dehumidifying an air stream, comprising:

a multiple effect evaporator for creating a concentrate desiccant solution;

a desiccant spray chamber, for spraying desiccant received from the multiple effect evaporator into the air stream such that the desiccant solution absorbs water vapor from the air stream creating a water and desiccant solution;

a conduit for conveying the water and desiccant solution to the multiple effect evaporator where the absorbed water is removed from the desiccant solution; and wherein the water and desiccant solution leaving the desiccant spray chamber is heated in a heat exchanger by the concentrated desiccant solution leaving the multiple effect evaporator.

18. A dehumidifier for dehumidifying an air stream, comprising:

a multiple effect evaporator for creating a concentrate desiccant solution;

a desiccant spray chamber, for spraying desiccant received from the multiple effect evaporator into the air stream such that the desiccant solution absorbs water vapor from the air stream creating a water and desiccant solution;

a conduit for conveying the water and desiccant solution to the multiple effect evaporator where the absorbed water is removed from the desiccant solution; and an air-cooling chamber comprising a vapor compression refrigeration system;

wherein a dehumidified air stream exits the spray chamber and enters the air-cooling chamber for cooling the air stream.

19. A dehumidifier for dehumidifying an air stream, comprising:

a multiple effect evaporator for creating a concentrate desiccant solution;

a desiccant spray chamber, for spraying desiccant received from the multiple effect evaporator into the air stream such that the desiccant solution absorbs water vapor from the air stream creating a water and desiccant solution;

a conduit for conveying the water and desiccant solution to the multiple effect evaporator where the absorbed water is removed from the desiccant solution; and an air-cooling chamber comprising an evaporative cooler;

wherein a dehumidified air stream exits the spray chamber and enters the air-cooling chamber for cooling the air stream.

20. A dehumidifier for dehumidifying an air stream, comprising:

a multiple effect evaporator for creating a concentrate desiccant solution;

a desiccant spray chamber, for spraying desiccant received from the multiple effect evaporator into the air stream such that the desiccant solution absorbs water vapor from the air stream creating a water and desiccant solution;

a conduit for conveying the water and desiccant solution to the multiple effect evaporator where the absorbed water is removed from the desiccant solution; and an air-cooling chamber comprising an absorption refrigeration system;

wherein a dehumidified air stream exits the spray chamber and enters the air-cooling chamber for cooling the air stream.

21. A method of dehumidifying an air stream, comprising:

providing a water and desiccant solution to a multiple effect evaporator, the water and desiccant solution comprising a potassium formate solution that is precooled in an evaporator cooler;

removing water from the water and desiccant solution using the multiple effect evaporator to provide a concentrate potassium formate solution;

providing an airflow stream into a desiccant spray chamber;

conveying the desiccant solution from the multiple effect evaporator to the desiccant spray chamber, and spraying desiccant into the airflow stream such that water vapor from the airflow stream is absorbed into the desiccant solution; and returning the water and desiccant solution from the spray chamber to the multiple effect evaporator.

22. A method of dehumidifying an air stream, comprising:

providing a water and desiccant solution to a multiple effect evaporator;

removing water from the water and desiccant solution using the multiple effect evaporator to provide a concentrate desiccant solution;

providing an airflow stream into a desiccant spray chamber;

conveying the desiccant solution from the multiple effect evaporator to the desiccant spray chamber, and spraying desiccant into the airflow stream such that water vapor from the airflow stream is absorbed into the desiccant solution;

returning the water and desiccant solution from the spray chamber to the multiple effect evaporator;

heating the water and desiccant solution in a heat exchanger as it returns from the spray chamber to the multiple effect evaporator using concentrated desiccant solution that is exiting the multiple effect evaporator.

* * * * *